US006510571B1

(12) United States Patent
Tittle et al.

(10) Patent No.: US 6,510,571 B1
(45) Date of Patent: Jan. 28, 2003

(54) MODULAR SUPPORT FOR OVERSIZED QUEEN MATTRESS

(75) Inventors: Gary R. Tittle, Pickerington, OH (US); William M. Wiggins, Parkersburg, WV (US)

(73) Assignee: Shottenstein Stores Corporation, Columbus, OH (US)

( * ) Notice: Subject to any disclaimer, the term of this patent is extended or adjusted under 35 U.S.C. 154(b) by 0 days.

(21) Appl. No.: 10/020,711

(22) Filed: Dec. 14, 2001

(51) Int. Cl.[7] ..... A47C 19/00
(52) U.S. Cl. ..... 5/400; 5/200.1; 5/201
(58) Field of Search ..... 5/400, 181, 200.1, 5/201, 202, 659

(56) References Cited

U.S. PATENT DOCUMENTS

| | | | | | |
|---|---|---|---|---|---|
| 2,847,685 | A | | 8/1958 | Freedlander | 5/354 |
| 4,125,912 | A | | 11/1978 | Courter | 5/370 |
| 4,128,907 | A | * | 12/1978 | Gelbart | 5/200.1 |
| 4,271,547 | A | | 6/1981 | Grossutti | 5/181 |
| 4,402,097 | A | | 9/1983 | Scott | 5/181 |
| 4,507,815 | A | * | 4/1985 | Danko | 5/400 |
| 4,675,929 | A | * | 6/1987 | Santo | 5/400 |
| 4,696,071 | A | | 9/1987 | Santo | 5/451 |
| 4,729,136 | A | * | 3/1988 | Santo | 5/400 X |
| 4,774,733 | A | * | 10/1988 | Akers | 5/400 X |
| 4,841,586 | A | | 6/1989 | Juster et al. | 5/181 |
| 4,998,310 | A | | 3/1991 | Olson | 5/449 |
| 5,144,706 | A | | 9/1992 | Walker | 5/400 |
| 5,289,600 | A | * | 3/1994 | Schermel | 5/400 |
| 5,471,688 | A | | 12/1995 | Cavazos | 5/251 |
| 5,564,140 | A | | 10/1996 | Shoenhair et al. | 5/400 |
| 5,970,547 | A | | 10/1999 | Cavazos | 5/690 |
| 6,055,689 | A | | 5/2000 | Cavazos | 5/690 |

FOREIGN PATENT DOCUMENTS

| | | | | |
|---|---|---|---|---|
| GB | 1308852 | * | 3/1973 | 5/400 |

OTHER PUBLICATIONS

Simmons, *Better Sleep Through Science.*™, Furniture/Today, Jun. 25, 2001 (1 page).

* cited by examiner

*Primary Examiner*—Robert G. Santos
(74) *Attorney, Agent, or Firm*—Wood, Herron & Evans, LLP

(57) ABSTRACT

A modular support for an oversized queen mattress includes a pair of modules each having a box spring unit with the box spring units sized to have a width equal to one-half that of a conventional unitary queen mattress and a length equal to that of the conventional queen mattress. Each module also has a platform fixed to its top surface. The platforms are sized to collectively support, when in abutting relation, an oversized queen mattress placed atop the abutting modules. The box spring units, when butted together along their respective confronting inside longitudinal edges and positioned within the rectangular opening of a conventional queen size bed frame, support the oversized queen mattress in a conventional size queen bed frame.

9 Claims, 3 Drawing Sheets

MODULAR SUPPORT FOR OVERSIZED QUEEN MATTRESS

FIELD OF THE INVENTION

This invention relates to bedding supports, and more particularly to a modular support for an oversized queen mattress.

BACKGROUND OF THE INVENTION

Bedding is generally available in standard sizes, such as twin, full, queen, and king sizes. While some consumers may prefer to have a large bed, they are often limited to smaller sizes due to the size of existing bed frames or the dimensions of their dwelling rooms or entryways. In an effort to provide consumers with more choices, bedding manufacturers have developed products to accommodate consumer preference for larger bedding. One example is the modular box spring for use with queen or king mattresses, wherein a two-piece box spring comprised of smaller box spring units is able to fit through doors and stairways that are too small to accommodate conventional, one-piece queen or king-size box springs.

Following a trend of consumer preference for larger bedding, a new development in the bedding industry has emerged for an oversized queen mattress. This oversized queen mattress has a width greater than that of conventional queen mattresses, thus providing a bed size between conventional queen and king sizes. In particular, a conventional queen-size mattress measures 80 inches in length and 60 inches in width. An oversized queen mattress measures 80 inches in length, but measures 66 inches in width. A convention king-size mattress measures 80 inches in length and 76 inches in width.

The oversized queen mattress may thus be desirable to consumers who prefer to have larger bedding but cannot either afford or accommodate a king-size bed. However, the oversized queen mattress also presents problems for manufacturers and consumers with regard to providing an adequate support for the larger size. In one aspect, conventional queen bed frames are too small, and conventional king bed frames are too large to accommodate a matching oversized, unitary construction queen box spring. In another aspect, the greater width of a matching unitary construction queen box spring compounds the dimensional limitations that restrict some consumers to smaller sized bedding.

With reference to FIG. 1, there is depicted a prior art approach to resolving the bed frame size problem associated with utilizing a conventional queen-size box spring to support an oversize queen mattress. In this approach, a unitary platform 2, having a width $W_3$ which is equal to the width $W_1$ of an oversized queen mattress 12, is placed on top of a conventional, unitary queen-size box spring 4, having a width $W_2$ equal to the width of a conventional queen mattress. While this device provides support to the oversized queen mattress 12, it does not address the problems associated with the bulky dimensions of the single-piece box spring 4. In fact, the platform's greater width $W_3$ makes it even more difficult to move the device through narrow entryways and sharp turns. The device also presents safety concerns in that it is not attached to the box spring 4 and therefore may drift off center during use, creating the potential for the mattress 12 to fall under the weight of a user.

There is thus a need for a bed support which can be used with a conventional queen-sized bed frame to safely provide full support for an new oversized queen mattress, while at the same time being able to accommodate the entry way and sharp turn dimensional limitations faced by some consumers.

SUMMARY OF THE INVENTION

The present invention, in one preferred form, includes a modular support comprising a pair of identically-configured, physically separate modules, for supporting an oversized queen mattress. The modules, when mounted in juxtaposition, fit a conventional queen-size bed frame. Each module is comprised of a box spring unit and platform. The modules are each smaller than a conventional queen-size box spring, thereby facilitating movement of the modules through narrow passages such as hallways or stairways, especially when a sharp turn must be negotiated. The modules of the modular support can be moved into a room that would be otherwise inaccessible to a conventional queen-size box spring unit, and can be assembled together to provide support for an oversized queen mattress. The modular support of the present invention provides a box spring type support for an oversized queen mattress that overcomes the dimensional limitations of conventional unitary queen-size box springs and which can be used with a conventional queen bed frame.

The box spring unit of each module is sized such that, when the modules are combined, the box spring units of the modules collectively are equivalent to a conventional queen-sized box spring. The platform of each module is positioned on a support surface of its respectively associated box spring unit. When the modules are juxtaposed, the platforms thereof have a combined width greater than the width of the combined box spring units and equal to the width of an oversized queen mattress. Each platform is positioned on the support surface of its respectively associated box spring unit with its outer edge extending laterally beyond the outer edge of its associated box spring unit, and its inner edge aligned with the inner edge of its associated box spring unit. When the modular box spring units are placed adjacent one another such that their respective inner longitudinal edges are butted together, their respectively associated platforms collectively provide a total surface area equal to that of the overlying oversized queen mattress, which is greater than that of a conventional queen-size box spring, yet the butted pair of modular box spring units may still be mounted within a conventionally sized queen bed frame. In accordance with a further aspect of the invention, an oversized queen mattress and box spring assembly incorporating the modules of this invention is provided which fits in a conventional queen bed frame, thereby providing an oversized queen bed supported by a conventional queen bed frame.

In an exemplary embodiment, the width of each modular box spring unit is 30 inches and the width of each platform is 33 inches, leaving a 3 inch overhang along the outer longitudinal edge of the box spring unit. In this configuration, the assembled modules provide a combined width of 66 inches to accommodate a corresponding oversized queen mattress having a width of 66 inches. The length of the platforms and box spring units are equal to each other and to the length of the oversized queen size mattress.

In another exemplary embodiment, the platform of each modular unit is fixedly attached to the support surface of its respective box spring unit to prevent shifting of the platform relative to its associated box spring unit. These and other features, advantages and objectives of the invention will become more readily apparent to those of ordinary skill in the art upon review of the following detailed description of the preferred embodiments, taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION OF THE INVENTION

Figure 1:
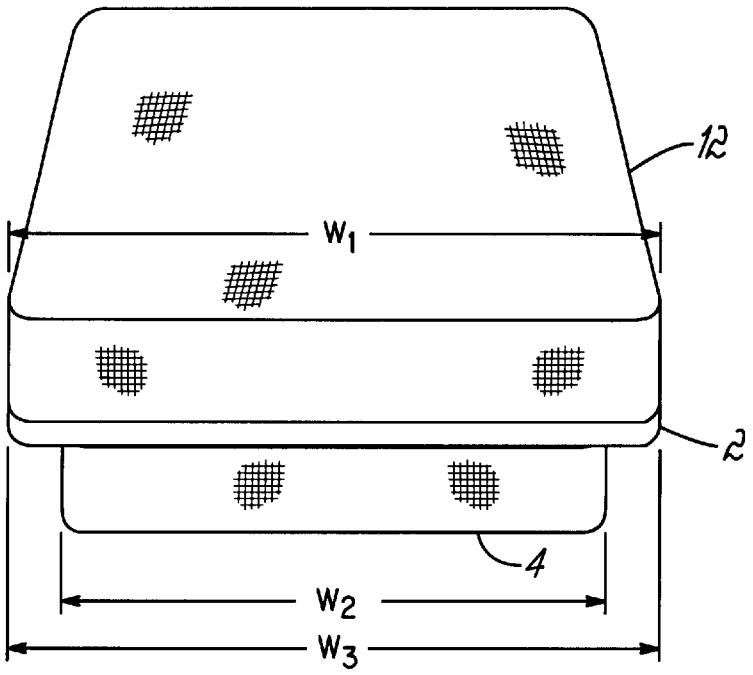
PRIOR ART FIG. 1
FIG. 1 is a perspective view depicting a prior art apparatus for supporting an oversized queen mattress on a conventional unitary queen box spring.
Figure 2:
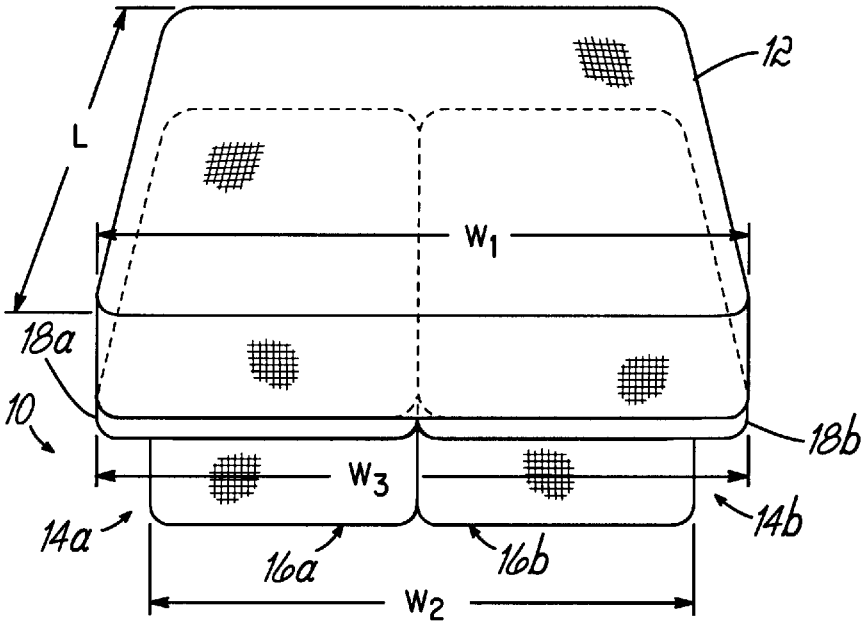
FIG. 2 is a perspective view depicting a preferred embodiment of an oversized queen mattress and box spring assembly of the present invention.
Figure 3:
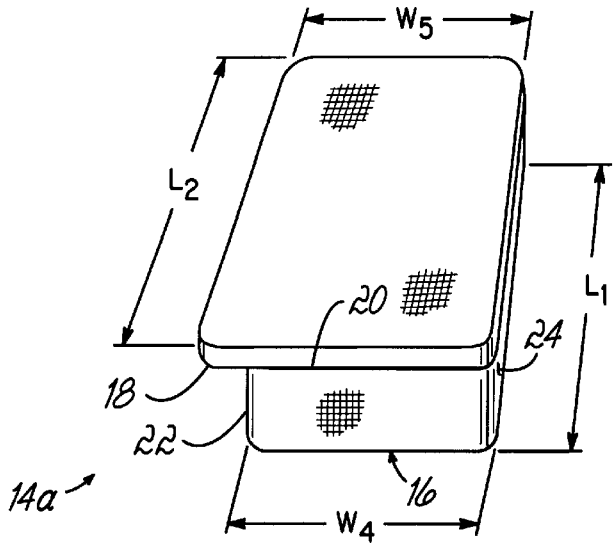
FIG. 3 is a perspective view of a module of the present invention.
Figure 4:
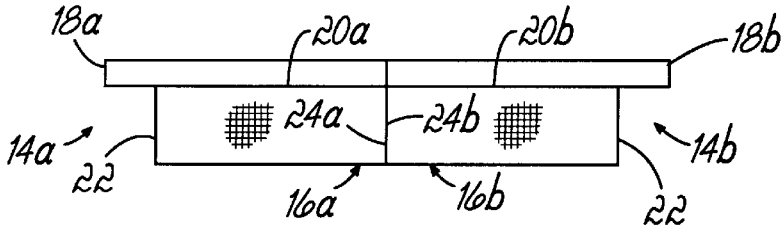
FIG. 4 is an end view of the modular support of the present invention for an oversized queen mattress.

Referring to FIG. 2, a modular support 10 according to the principles of the present invention for supporting an oversized queen mattress 12 in a conventional sized queen bedframe (shown in FIG. 6) includes a pair of modules 14*a*, 14*b*, which are preferably identical, and which can be placed adjacent to one another to collectively provide a support surface for the entire bottom surface of the oversized queen mattress 12. With reference to FIGS. 2–4, each module 14*a*, 14*b* is comprised of a box spring unit 16*a*, 16*b* having a length $L_1$ equal to the length of a conventional queen-size mattress and having a width $W_4$ equal to one-half of the width of a conventional queen-size mattress. The modules 14*a*, 14*b* further include rigid platforms 18*a*, 18*b*, respectively, positioned on top support surfaces 20*a*, 20*b*, respectively, of the box spring units 16*a*, 16*b*, respectively. The rigid platforms 18*a*, 18*b* each have a length $L_2$ equal to the length $L_1$ of the box spring units 16*a*, 16*b*, but have a width $W_5$ that is greater than the width $W_4$ of the box spring units. The rigid platforms 18*a*, 18*b* are situated on their respectively associated box spring units 16*a*, 16*b* so that the width $W_5$ of each rigid platform overhangs an outer longitudinal side edge 22 of the associated box spring unit. The invention utilizes a pair of these modules 14*a*, 14*b* placed adjacent to one another so that their respective inner longitudinal edges 24*a*, 24*b* butt against one another as shown in FIG. 4. In this manner, the modules may be supported within a conventional queen size bedframe, while providing a total platform surface area at the upper portion of the modular support 10 to fully underlie and support the entire full width $W_1$, and length L of an oversized queen mattress 12.

Figure 5:
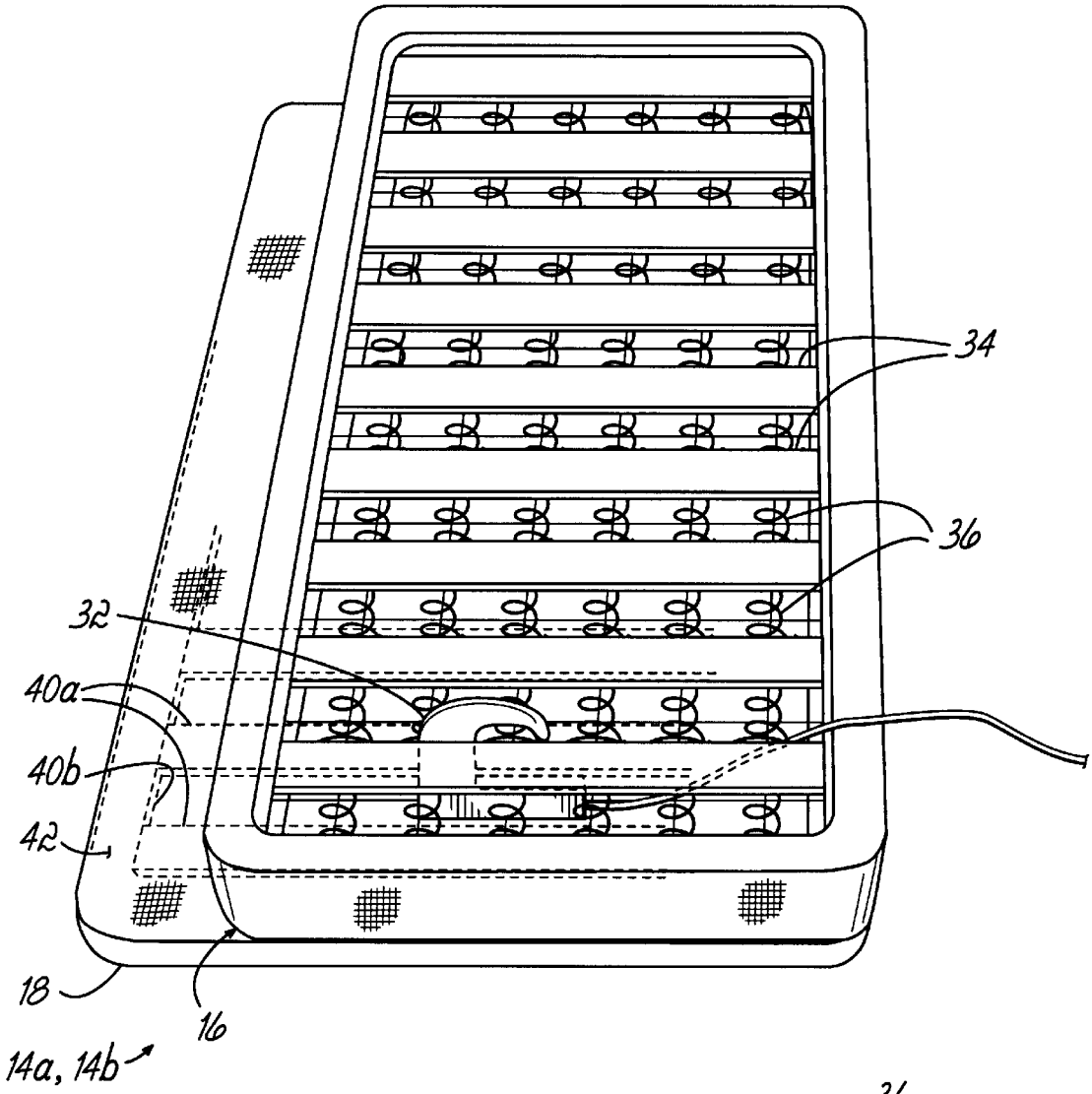
FIG. 5 is a perspective view of the underside of a module of the present invention depicting one method of attaching the platform to the box spring unit.
Figure 5A:
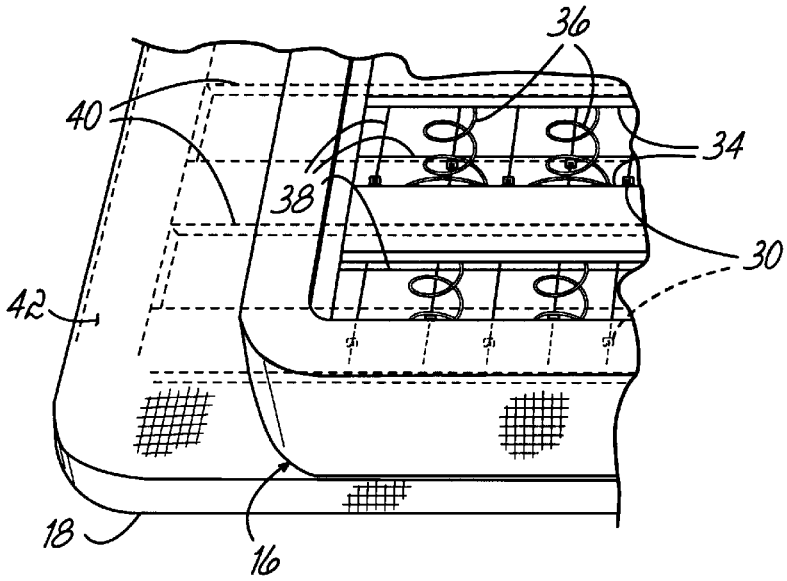
FIG. 5A is an enlarged view of a portion of the module of FIG. 5.

In an exemplary embodiment, the rigid platforms 18*a*, 18*b* are each fixedly attached to the top surface of their respectively associated individual box spring units 16*a*, 16*b* to prevent the platform from shifting relative to their respectively associated box spring units during use, thereby providing a stable support for the oversize queen mattress 12. The platforms 18*a*, 18*b* may be attached to the box spring units 16*a*, 16*b* by joining the platforms 18 to their associated box spring units with staples, or by any other suitable means capable of fixedly attaching the platforms to their associated box spring units. Referring to FIGS. 5 and 5A, a method of attaching a platform 18 to a box spring unit 16 using staples 30 is depicted. Box spring unit 16 is positioned on top of a platform 18 such that the top support surface 20 rests upon the underside of the platform 18 and the underside of box spring unit 16 is exposed. Staples 30 may be applied with a staple gun 32 to the underside of box spring unit 16 between box spring slats 34 and coil springs 36 to secure a wire grid 38 of the box spring unit 16 to a platform frame 40 comprising slats 40*a* spanning sides 40*b*. The slats 40*a* and sides 40*b* of frame 40 are concealed by fabric cover material 42.

The modular design of the modules 14*a*, 14*b* permits the modular support 10 to be disassembled and moved through narrow entryways and hallways, and to be readily assembled to provide a stable support for an oversize queen mattress 12.

Figure 6:
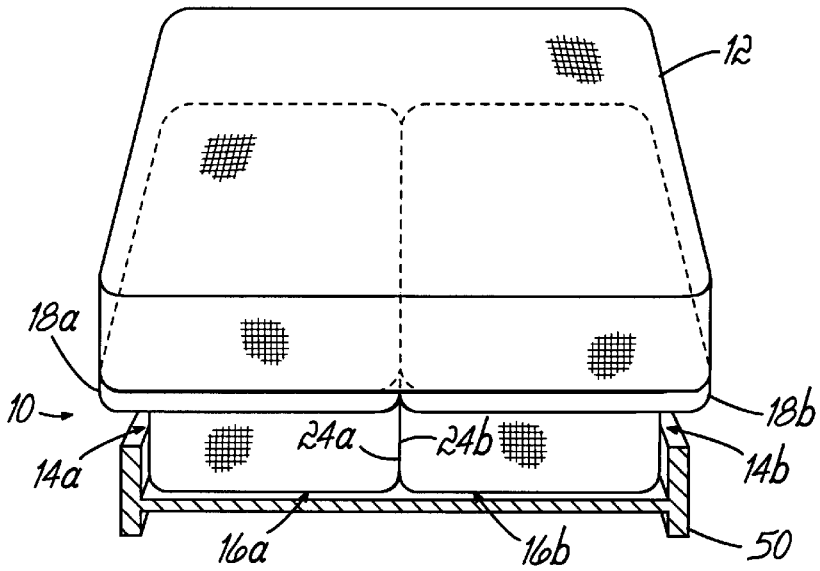
FIG. 6 is a perspective view of an oversized queen bed of the present invention.

Referring to FIG. 6, a bed with an oversized queen mattress 12 is shown supported on an exemplary modular support 10 of the present invention and mounted within a conventional queen bedframe 50. The conventional bedframe 50 is generally rectangular in shape and defines a generally rectangular-shaped opening for receiving modules 14*a*, 14*b* of the modular support 10, positioned adjacent one another with their inner longitudinal edges 24*a*, 24*b* butted together. In this arrangement, the modules 14*a*, 14*b*, mounted within the conventional bedframe 50, provide a support for the oversized queen mattress 12 as described above.

While the present invention has been illustrated by the description of a preferred embodiment thereof, and while the preferred embodiment has been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope or spirit of applicant's general inventive concept.

What is claimed is:

1. A modular support for an oversized queen mattress having a length equal to that of a conventional queen mattress and a width greater than that of a conventional queen mattress, the support comprising:

a pair of box spring units, each box spring unit having a length equal to that of a conventional queen mattress and a width equal to one-half that of a conventional queen mattress, each box spring unit further having an upper support surface, an inner longitudinal side edge, and an outer longitudinal side edge;

a pair of substantially rigid platforms, each platform being supported on the upper support surface of a respective one of the pair of box spring units, and having a length equal to the length of said box spring units and a width greater than the width of said box spring units, the platforms supported such that the longitudinal edges thereof extend beyond the outer edges of the box spring units only along the outer longitudinal side edge thereof; and the box spring units positioned adjacent one another in juxtaposed relation such that the inner longitudinal edges are abutting and the overhanging platforms collectively provide a total support area configured to underlie the entire bottom surface of an overlying oversized mattress to fully support the oversized mattress.

2. The mattress support of claim 1 wherein the width of each box spring unit is 30 inches.

3. The mattress support of claim 2 wherein the width of each platform is 33 inches.

4. The mattress support of claim 1 wherein each platform is fixedly mounted to the support surface of its respectively associated one of the pair of box spring units.

5. An oversized queen mattress and box spring assembly comprising:

an oversized queen mattress having a length equal to that of a conventional queen mattress and a width greater than that of a conventional queen mattress; and a modular support for the oversized queen mattress, the modular support comprising:

a pair of box spring units, each box spring unit having a length equal to that of a conventional queen mattress and a width equal to one-half that of a conventional queen mattress, each box spring unit further having an upper support surface, an inner longitudinal side edge, and an outer longitudinal side edge, a pair of substantially rigid platforms, each platform being supported on the upper support surface of a respective one of the pair of box spring units, and having a length equal to the length of said box spring units and a width greater than the width of said box spring units, the platforms supported such that the longitudinal edges thereof extend beyond the outer edges of the box spring units only along the outer longitudinal side edge thereof, and the box spring units positioned adjacent one another in juxtaposed relation such that the inner longitudinal edges are abutting and the overhanging platforms collectively provide a total support area configured to underlie the entire bottom surface of an overlying oversized mattress to fully support the oversized mattress.

6. The assembly of claim 5 wherein the width of each box spring unit is 30 inches.

7. The assembly of claim 6 wherein the width of each platform is 33 inches.

8. The assembly of claim 1wherein each platform is fixedly mounted to the support surface of its respectively associated one of the pair of box spring units.

9. An oversized queen bed comprising:

a conventional size queen bed frame having a rectangular frame defining an opening configured to receive and support a conventional size queen box spring;

an oversized queen mattress having a length equal to that of a conventional queen mattress and a width greater than that of a conventional queen mattress;

a modular support for the oversized queen mattress, the modular support comprising:

a pair of box spring units, each box spring unit having a length equal to that of a conventional queen mattress and a width equal to one-half that of a conventional queen mattress, each box spring unit further having an upper support surface, an inner longitudinal side edge, and an outer longitudinal side edge, a pair of substantially rigid platforms, each platform being supported on the upper support surface of a respective one of the pair of box spring units, and having a length equal to the length of said box spring units and a width greater than the width of said box spring units, the platforms supported such that the longitudinal edges thereof extend beyond the outer edges of the box spring units only along the outer longitudinal side edge thereof, and the box spring units positioned adjacent one another in juxtaposed relation such that the inner longitudinal edges are abutting and the overhanging platforms collectively provide a total support area configured to underlie the entire bottom surface of an overlying oversized mattress to fully support the oversized mattress; and the juxtaposed box spring units being positioned in the opening in said rectangular frame of said conventional size queen bedframe and supported thereby.

* * * * *

UNITED STATES PATENT AND TRADEMARK OFFICE

CERTIFICATE OF CORRECTION

PATENT NO. : 6,510,571 B1
DATED : January 28, 2003
INVENTOR(S) : Tittle et al.

It is certified that error appears in the above-identified patent and that said Letters Patent is hereby corrected as shown below:

Column 6,
Line 5, reads "assembly of claim 1 wherein" and should read -- assembly of claim 5 wherein --.

Signed and Sealed this

Ninth Day of September, 2003

JAMES E. ROGAN
*Director of the United States Patent and Trademark Office*